United States Patent [19]

Kanemitsu

[11] Patent Number: 4,633,557

[45] Date of Patent: Jan. 6, 1987

[54] METHOD OF MAKING POLY-V PULLEYS

[75] Inventor: Yukio Kanemitsu, Hyogo, Japan

[73] Assignee: Kabushiki Kaisha Kanemitsu, Japan

[21] Appl. No.: 710,166

[22] Filed: Apr. 15, 1985

Related U.S. Application Data

[62] Division of Ser. No. 400,415, Jul. 21, 1982, Pat. No. 4,518,374.

[30] Foreign Application Priority Data

Dec. 24, 1981 [JP] Japan ..... 56-212370

[51] Int. Cl.[4] ..... B21K 1/42

[52] U.S. Cl. ..... 29/159 R; 72/68

[58] Field of Search ..... 29/159 R; 72/105, 68, 72/84, 85; 474/170

[56] References Cited

U.S. PATENT DOCUMENTS

| | | | |
|---|---|---|---|
| D. 266,982 | 11/1982 | Kanemitsu | D8/360 |
| D. 266,983 | 11/1982 | Kanemitsu | D8/360 |
| D. 266,984 | 11/1982 | Kanemitsu | D8/360 |
| D. 267,472 | 1/1983 | Kanemitsu | D8/360 |
| D. 267,540 | 1/1983 | Kanemitsu | D8/360 |
| D. 267,541 | 1/1983 | Kanemitsu | D8/360 |
| D. 268,092 | 3/1983 | Kanemitsu | D8/360 |
| 2,139,833 | 12/1938 | Le Jeune et al. | 29/159.1 |
| 2,471,906 | 5/1949 | Smith | 474/170 |
| 2,787,914 | 4/1957 | Nelson | 474/168 |
| 2,878,551 | 3/1959 | Woodward | 29/159.1 |
| 3,368,376 | 2/1968 | Previte | 72/82 |
| 3,457,751 | 7/1969 | Lindeman | 72/105 |
| 3,722,309 | 3/1973 | Shaffer | 474/169 |
| 3,772,928 | 11/1973 | Gobeille | 74/230.7 |
| 3,838,485 | 10/1974 | Oldford | 474/170 |
| 3,907,371 | 9/1975 | Leudi et al. | 29/159.1 |
| 3,945,102 | 3/1976 | Kotlar | 29/159 R |
| 3,953,995 | 5/1976 | Haswell et al. | 72/105 |
| 3,962,926 | 6/1976 | Kotlar | 474/168 |
| 3,977,264 | 8/1976 | Sproul | 29/159 R |
| 3,994,181 | 11/1976 | Sproul | 474/170 |
| 4,050,321 | 9/1977 | Kraft | 74/230.8 |
| 4,059,023 | 11/1977 | Sproul | 474/170 |
| 4,078,410 | 3/1978 | Lemmo | 72/82 |
| 4,080,704 | 3/1978 | Blakesley | 29/159 R |
| 4,083,215 | 4/1978 | Guetzlaff | 72/82 |
| 4,086,798 | 5/1978 | Lemmo | 72/82 |
| 4,197,756 | 4/1980 | Yaros | 74/230.3 |
| 4,273,547 | 6/1981 | Bytzek | 474/170 |
| 4,313,323 | 2/1982 | Kanemitsu | 72/84 |

FOREIGN PATENT DOCUMENTS

| | | | |
|---|---|---|---|
| 2822056 | 11/1979 | Fed. Rep. of Germany | 474/170 |
| 508176 | 1/1955 | Italy | 474/170 |
| 56-143863 | 11/1981 | Japan | 29/159 R |

OTHER PUBLICATIONS

Semitool Brochure on Rinser/Dryers (38320), 1983.

*Primary Examiner*—Howard N. Goldberg
*Assistant Examiner*—P. W. Echols
*Attorney, Agent, or Firm*—Steele, Gould & Fried

[57] ABSTRACT

A sheet metal poly-V pulley is made by forming a cup-shaped blank having a cylindrical wall with inner and outer peripheral surfaces, thickening the cylindrical wall by compressing the blank axially while rolling it, then rolling the thickened blank on shaped rollers to form corresponding inter-spaced inner and outer grooves. The outer grooves are deep V-shapes impressed with rollers; the inner grooves are shallow V-shapes formed by pressure against the surface of a rotary support for the cup shaped blank during rolling. The plurality of parallel V-shaped annular grooves in the outer peripheral surface receive poly-V belts, and the plurality of smaller V-shaped annular grooves on the inner peripheral surface are aligned between the outer partition walls and cause more-precise positioning of the outer grooves. Flared flanges are formed at opposite ends of the thickened portion projecting radially beyond the partition walls, the flanges having stepped, cut-out portions for receiving the edges of poly-V belts.

3 Claims, 12 Drawing Figures

Fig.7

METHOD OF MAKING POLY-V PULLEYS

CROSS REFERENCE TO RELATED APPLICATION

This is a division of application Ser. No. 400,415, filed July 21, 1982, now U.S. Pat. No. 4,518,374.

BACKGROUND OF THE INVENTION

1. Field of the Invention

The present invention relates to improvements in a method of manufacturing poly-V pulleys and such products, and more particularly to improvements in a method of manufacturing poly-V pulleys with the use of a step of thickening the pulley peripheral wall.

2. Prior Art

In recent years sheet metal poly-V pulleys have been widely used, each of which is made in such a way that a metal plate is subjected to drawing to produce a cup-shape blank, and then a plurality of annular sharp V-grooves called poly-V grooves are formed in the peripheral wall of such cup-shape blank. As compared with pulleys made with the use of a widely known mold, such sheet metal poly-V pulleys present advantages in that they are of lighter weight and manufactured with reduced costs. Therefore, such poly-V pulleys have been widely used in the automobile industry or the like.

As far as is known, there are two types of sheet metal poly-V pulleys and methods of manufacturing the same.

According to a first type, the cylindrical peripheral wall of a cup-shape blank is compressingly folded to produce V-shape grooves, so that a completed product poly-V pulley is obtained.

According to a second type, as disclosed in U.S. Pat. No. 4,273,547, a so-called peripheral wall thickening step is used; namely, the cylindrical peripheral wall of a cup-shape blank is thickened before being subjected to rolling with the use of a V-shape groove-forming roller.

The present invention relates to improvements in the invention of the second type mentioned above.

U.S. Pat. No. 4,273,547 discloses a poly-V pulley made in such a way that a metal plate is subjected to drawing to produce a cup-shape blank, the cylindrical peripheral wall of the cup-shape blank is then thickened, and a so-called rolling is performed with a V-shape groove-forming roller pressingly applied to the outer surface of the thickened cylindrical peripheral wall, thereby forming a plurality of parallel V-shape annular grooves in this outer surface, running in the peripheral direction of the cylindrical peripheral wall.

As the result, today it is possible to manufacture practical poly-V pulley having a sufficient mechanical strength even though made with a thin metal plate processed with low manufacturing costs. However, it was nevertheless desirable to develop a more economical poly-V pulley of lighter weight.

SUMMARY OF THE INVENTION

Accordingly, the present invention is proposed to comply with such requirements. Namely, the present invention is made to improve a poly-V pulley and its manufacturing method with the use of a peripheral wall thickening step, thereby obtaining a lighter poly-V pulley having more precise V-grooves with reduced costs and higher productivity.

It is therefore an object of the present invention to provide a method of manufacturing light-weight poly-V pulleys having more precise V-grooves with reduced manufacturing costs.

It is another object of the present invention to provide a method of manufacturing sheet metal poly-V pulleys in an easier way with improved productivity.

BRIEF DESCRIPTION OF THE DRAWINGS

The present invention will be described, by way of example, with reference to the accompanying drawings, in which.

DETAILED DESCRIPTION OF THE PREFERRED EMBODIMENTS

The manufacturing method in accordance with the present invention comprises the steps of forming a cup-shape blank by drawing a metal plate (hereinafter referred to as a preliminary forming step), thickening the cylindrical peripheral wall of the cup-shape blank (hereinafter referred to as a thickening step) and forming a plurality of V-shape annular grooves called poly-V grooves in the thickened peripheral wall of the cup-shape blank (hereinafter referred to as a V-shape groove forming step).

(1) Preliminary forming step

Figure 1:
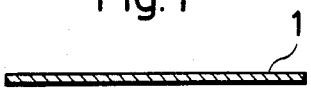
FIG. 1 is a view illustrating a metal plate to be used for manufacturing a poly-V pulley in accordance with the present invention.
Figure 2:
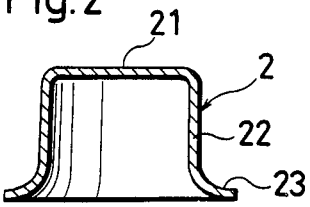
FIGS. 2 and 3 are vertical section views of a cup-shape blank.

According to the preliminary forming step, a metal plate as shown in FIG. 1 is drawn to form a cup-shape blank 2 having a circular bottom 21 and a cylindrical peripheral wall 22 vertically extending from the periphery of the bottom 21 as shown in FIG. 2. Since the principle and procedures of such drawing process are well known, they should be easily understood by those skilled in the art.

Figure 3:
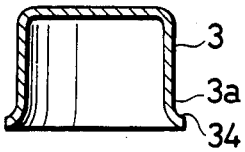

The opening edge 23 of the cup-shape blank 2 formed according to the preliminary forming step is cut as necessary to produce a well-shaped cup-shape blank 3 as shown in FIG. 3.

(2) Thickening step

Figure 4:
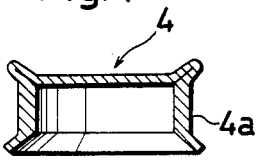
FIG. 4 is a vertical section view of the cup-shape blank (semi-completed product) with the peripheral wall thereof thickened.
Figure 6:
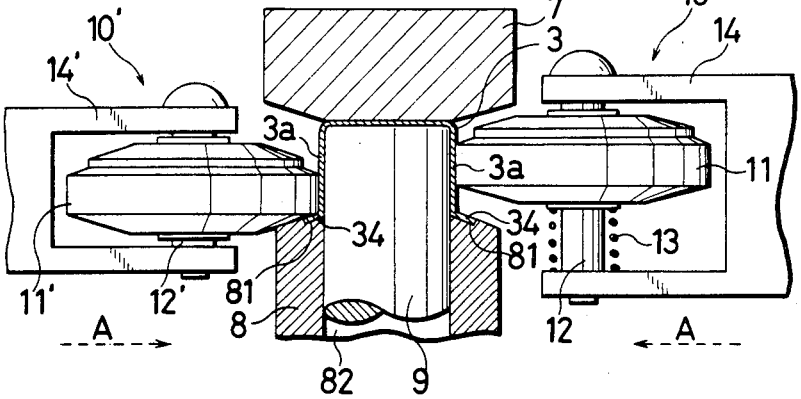
FIGS. 6 and 7 are views illustrating the procedures of a wall thickening step.
Figure 7:
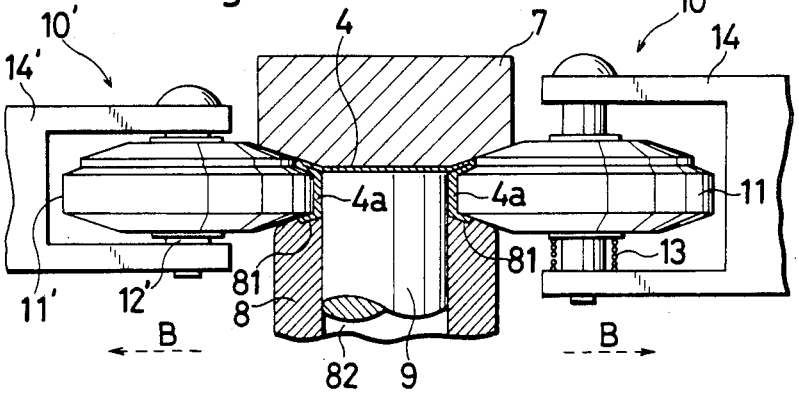
Figure 8:
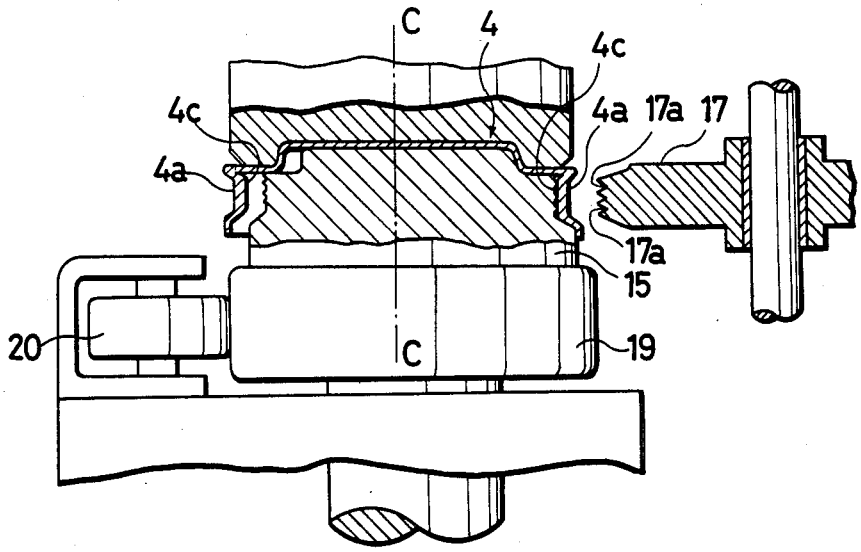
FIGS. 8 and 9 are views illustrating the procedures of a V-shape groove forming step.
Figure 9:
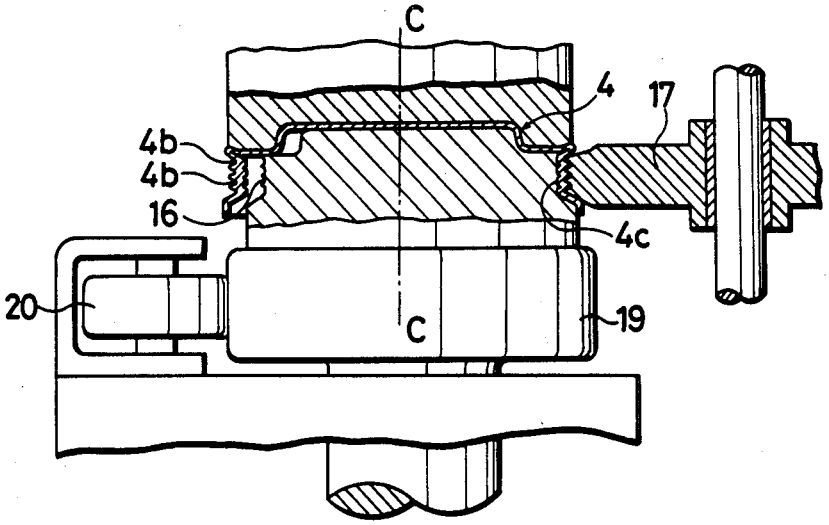

The thickening step is performed according to the procedures shown in FIGS. 6 and 7, so as to form a semi-completed pulley having a cylindrical peripheral wall **4*a* which is thickened as shown in FIG. 4**.

The description hereinafter will discuss a preferred embodiment of apparatus required for embodying the thickening step, before describing the procedures of this step.

In FIGS. 6 and 7, a pair of upper and lower rotary support members are generally designated by the reference numerals 7 and 8, respectively. The upper rotary support member 7 is vertically movable as necessary by suitable means (not shown). The cylindrical lower rotary support member 8 is provided in the upper inner peripheral edge with a fitting groove 81, into which the opening edge 34 of the cup-shape blank 3 is fitted such that the cup-shape blank 3 is properly seated on the lower rotary support member 8.

A rotary member 9 for constantly maintaining the blank shape is housed in the inner space formed by the cylindrical peripheral wall 82 of the lower rotary support member 8, in a manner vertically movable therein by spring means (not shown). This rotary member 9 is rotatable integrally with the lower rotary support member 81 during the thickening step.

Rotary roller devices 10 and 10′ for constantly maintaining the shape of the blank are disposed on either side of rotary member and between the pair of upper and lower rotary support members 7 and 8. These roller devices 10 and 10′ are movable in the directions A and B shown in FIGS. 6 and 7. The roller devices 10 and 10′ have rotary rollers 11 and 11′, respectively, which are rotatably supported by roller support frames 14 and 14′ through roller shafts 12 and 12′, respectively. The right-hand rotary roller 11 is resiliently supported by a pressure spring 13 put on the roller shaft 12. Rollers 11, 11′ and support members 7 and 8 are complementarily shaped such that when brought together as in FIG. 7, they define the shape of the thickened blank with flared flanges as shown in FIG. 4.

The apparatus constructed as discussed hereinbefore will be operated to thicken the cylindrical peripheral wall 3*a* of the cup-shape blank 3. Namely, the cup-shape blank 3 is placed on the rotary member 9 such that the opening edge 34 is engaged with the fitting groove 81 in the lower rotary support member 8. With the upper rotary support member 7 lowered, the cup-shape blank 3 is securely held in the vertical direction by the upper rotary support member 7 and the rotary member 9 of the lower rotary support member 8. The roller devices 10 and 10′ are then moved toward the cylindrical peripheral wall 3*a* of the cup-shape blank 23 in the direction A. As shown in FIG. 6, the rotary roller 11 of the right-hand roller device 10 engages the upper half of the cup-shape blank 3, while the rotary roller 11′ of the left-hand roller device 10′ engages the lower half of the cup-shape blank 3. After the cup-shape blank 3 has been properly seated, the pair of upper and lower rotary support members 7 and 8 are rotated at the same speed in the same direction, that is, synchronously.

During such synchronous rotation of the rotary support members 7 and 8, the upper rotary support member 7 is slowly lowered, while the pair of roller devices 10 and 10′, pressingly holding the cylindrical peripheral wall 3*a* of the cup-shape blank 3 in the horizontal direction, are moved away from the cylindrical peripheral wall 3*a* of the cup-shape blank 3. That is, while the upper rotary support member 7 is lowered, the rotary rollers 11 and 11′ of the roller device 10 and 10′ are slowly moved away from the cylindrical peripheral wall 3*a* of the cup-shape blank 3 in the direction B. As the blank progresses from the cup shape of FIG. 6 to the thickened cup shape with flared flanges of FIG. 7, the material of the blank at the opening edge 34 is conformed to fit in groove 81 on support 8, and the material adjacent support 7 is folded over.

At this step, it is important to move the roller devices 10 and 10′ away from the cylindrical peripheral wall 3*a* of the cup-shape blank 3 at a speed corresponding to the speed at which the cylindrical peripheral wall 3*a* is thickened by applying an axial compressive force to the cylindrical peripheral wall 3*a* with the pair of upper and lower rotary support members 7 and 8 in operation. The optimum speed at which the roller devices 10 and 10′ are moved away from the cylindrical peripheral wall 3*a*, is dependent on the thickness and material of the cylindrical peripheral wall 3*a* of the cup-shape blank 3 to be thickened.

When the cylindrical peripheral wall 3*a* of the cup-shape blank 3 is thickened according to the procedures above-mentioned, the smooth, uniform shape of the cylindrical peripheral wall 3*a*, which is deformed by the axial compressive force applied thereto, may be corrected by the rolling faces of the rotary rollers 11 and 11′ of the roller devices 10 and 10′ upon each rotation of the cup-shape blank 3. Thus, the cylindrical peripheral wall 3*a* of the cup-shape blank 3 may be thickened by a desired amount without any distortion of the roundness of the cup-shape blank 3.

With the advance of the peripheral wall thickening step, the upper rotary support member 7 comes in contact with the rotary roller 11 of the roller device 10. Since the rotary roller 11 is resiliently held by the pressure spring 13, the rotary roller 11 is lowered as it is pressed by the upper rotary support member 7. Thus, the rotary roller 11 is lowered to the level identical with that of the rotary roller 11′ of the left-hand roller device 10′ as shown in FIG. 7 when the peripheral wall thickening step is completed. The rotary member 9 resiliently held by a pressure spring is moved downwardly as the cylindrical peripheral wall 3*a* of the cup-shape blank 3 is shortened in length (and thickened). Thus, the peripheral wall thickening step may be smoothly performed.

(3) V-shape groove forming step

After the cylindrical peripheral wall 3*a* of the cup-shape blank 3 has been thickened to have a desired thickness according to the thickening step, the V-shape groove forming step is started, in which V-shape grooves are formed according to a so-called rolling process with the use of a V-shape groove forming roller.

The thickened cup-shape blank 4 (shown as semi-completed product in FIG. 4) is placed on an inner groove forming rotary mold 15 having an eccentric rotary axis c—c. A V-shape groove forming roller is pressingly applied to the outer peripheral surface 4*a* of the cup-shape blank 4. The V-shape groove forming roller 17 includes a rolling face 17*c* having a plurality of parallel V-shape crests 17*b* divided by steep valleys 17*a*, the crests 17*b* being formed in the peripheral direction of the roller 17.

Figure 11:
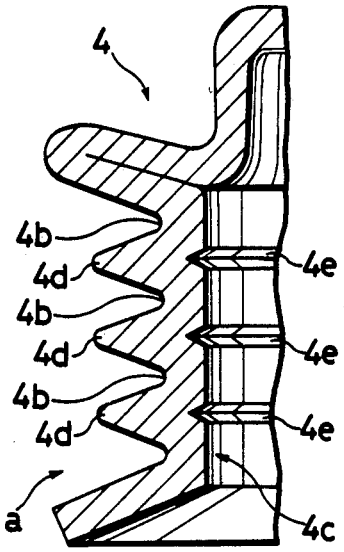
FIG. 11 is a vertical section view, with portions broken away, of main portions of the poly-V pulley in accordance with the present invention illustrating the V-grooves thereof; and, FIG. 12 is a vertical section view, with portions broken away, of main portions of another form of a poly-V pulley in accordance with the present invention.

Then, the rolling face 15*b* of the inner groove forming rotary mold 15 as rotated engages the inner peripheral surface 4*c* of the thickened peripheral wall 4*a* of the cup-shape blank 4. At the same time, the rolling face 17*c* of the V-shape groove forming roller 17 as rotated engages the outer peripheral surface 4*a* of the cup-shape blank 4. Thus, as shown in FIG. 11, there are simultaneously formed V-shape grooves 4*b* in the outer peripheral surface of the thickened cylindrical peripheral wall 4*a* of the cup-shape blank 4, and V-shape annular inner grooves **4*e* in the inner peripheral surface 4*c*. Namely, the V-shape groove forming step is performed with the rolling face 15*b* of the inner groove forming mold 15 and the rolling face 17*c* of the V-shape groove forming roller 17 both in rotation, being simultaneously engaging the inner and outer peripheral surfaces of the thickened cylindrical peripheral wall 4*a* of the cup-shape blank 4**, respectively.

Figure 10:
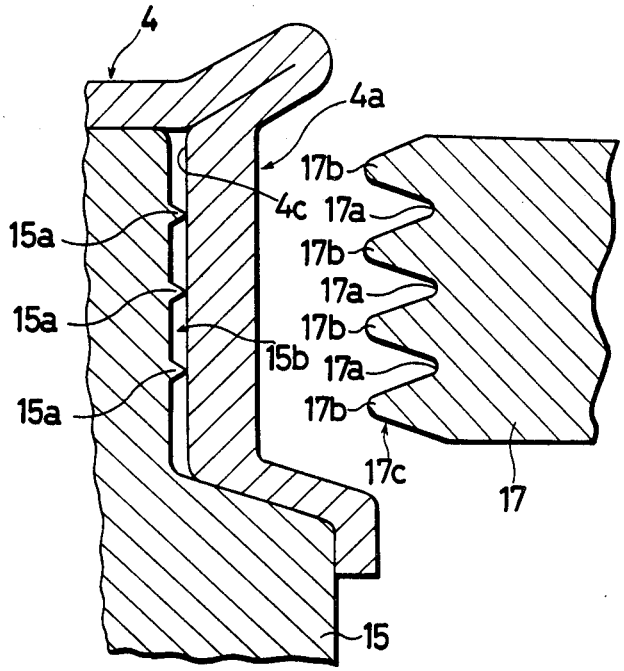
FIG. 10 is an enlarged view of a portion of FIG. 8.

As shown in FIG. 10, the inner groove forming rotary mold 15 is provided on the rolling face **15*b* with V-shape annular projections 15*a* in the peripheral direction of the mold 15 at predetermined intervals. The interval of the projections 15*a* is determined according to the pitch of the V-shape crests 17*b* formed on the rolling face 17*c* of the V-shape groove forming roller 17. Namely, these projections 15*a* are formed at the positions corresponding to the steep valleys 17*a* dividing the V-shape crests 17*b* formed on the rolling face 17*c* of the V-shape groove forming roller 17**.

A contact rotary roller 20 is contacted with the left-hand peripheral surface of a lower rotary holding member 19 which supports the inner groove forming rotary mold 15. The roller 20 is adapted to prevent an undesired side-movement of the holding member 19 when it is rotated. This roller 20 is preferably used when intending to further improve precision of the V-shape grooves.

Figure 5:
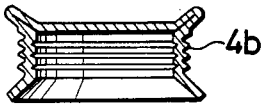
FIG. 5 is a vertical section view of a poly-V pulley as a completed product.

According to a series of the steps above-mentioned, there is produced a poly-V pulley as a completed product having the V-shape annular grooves **4*b* and the V-shape annular inner grooves 4*e* as shown in FIG. 5 and in more detail in FIG. 11**.

Figure 12:
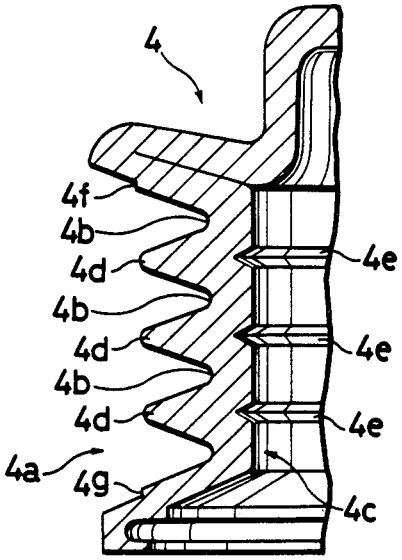

When a pair of upper and lower peripheral steps **4*f* and 4*g* as shown in FIG. 12 are formed, a poly-V belt (not shown) will be advantageously engaged in the V-shape annular grooves 4*b*** in a secure manner.

A poly-V pulley manufactured according to the series of steps discussed hereinbefore generally has V-shape grooves of high precision and can be made in an easier manner as compared with the conventional manufacturing methods mentioned at the beginning. In particular, the peripheral wall thickening step is remarkably simplified. Test results reveal that, according to the present invention, a poly-V pulley having a sufficient strength was produced by thickening the peripheral wall merely by about two thirds of a conventionally thickened wall. A light-weight poly-V pulley according to the present invention may be manufactured with reduced costs. Moreover, the present invention provides the following advantages which could not have been conventionally expected:

(1) Improvement in precision of V-shape annular grooves

In commercializing a poly-V pulley of the type discussed hereinbefore, it has most often been requested to improve the precision of the V-shape annular grooves. According to the present invention, the V-shape grooves are formed by the cooperative operation of the inner groove forming rotary mold and the V-shape groove forming roller which are respectively applied to the inner and outer surfaces of the cylindrical peripheral wall of the cup-shape blank at the V-groove forming step. Thus, V-shape groove forming is facilitated, so that V-shape grooves are accordingly more precisely formed.

(2) Improvement in productivity

According to the present invention, the step of thickening the cylindrical peripheral wall of a cup-shape blank is performed prior to the V-shape groove forming step. At this thickening step, it is sufficient to thicken the wall merely by about two-thirds of a conventionally thickened wall. Thus, the thickening step which normally requires much labor, is simplified, thereby improving productivity.

While the poly-V pulley in accordance with the present invention is manufactured according to the method discussed hereinbefore, the structural main portion or cylindrical peripheral wall of such poly-V pulley is as shown in FIG. 11 illustrating the vertical section, with portions broken away, of main portions of the wall.

As shown in FIG. 11, the thickened cylindrical peripheral wall **4*a* has in the outer peripheral surface thereof annular V-shape grooves 4*b* divided by tapering groove walls 4*d*. These annular V-shape grooves 4*b* are adapted to engage with the crests of a poly-V belt (not shown). The V-shape inner grooves 4*e* are formed in the inner peripheral surface of the cylindrical wall 4*a* at the positions corresponding to the tops of the tapering groove walls 4*d* formed on the outer peripheral surface of the wall 4. Formation of such inner grooves 4*e*** facilitates the V-shape groove forming step.

The poly-V pulley in accordance with the present invention constructed as discussed hereinbefore presents such advantages as mentioned in connection with the manufacturing method of the present invention. In particular, the poly-V pulley of the present invention may be manufactured with remarkably reduced costs, because of its light weight structure and reduction in material cost resulted from the simplification of the cylindrical peripheral wall thickening step.

What is claimed is:

1. A method of manufacturing a sheet metal poly-V pulley comprising the steps of:

forming a cup-shaped blank by drawing a sheet metal plate, said cup-shaped blank having a circular bottom and a cylindrical peripheral wall having inner and outer peripheral surfaces, extending from the periphery of said circular bottom;

thickening the cylindrical peripheral wall of said cup-shaped blank by supporting the blank between rotary support members while holding the cylindrical peripheral wall of said cup-shaped blank by radially-urged rotary roller devices, and, synchronously rotating and axially bringing together the rotary support members to thereby axially compress said cup-shaped blank while slowly separating said rotary rollers, allowing thickening of the peripheral wall of said cup-shaped blank; and, simultaneously forming a plurality of parallel v-shaped annular outer grooves and smaller v-shaped annular inner grooves respectively in the outer and inner peripheral surfaces of said cup-shaped blank, by applying a v-shaped groove forming outer roller and an inner groove forming rotary mold simultaneously to said out and inner peripheral surfaces, respectively, of said thickened cylindrical peripheral wall, said plurality of parallel v-shaped annular grooves being divided by tapering partition walls in the peripheral direction of said wall, said v-shaped annular inner grooves being smaller than said plurality of parallel v-shaped annular grooves and located at positions corresponding to the tops of said partition walls dividing said V-shaped grooves in said outer peripheral surface of said cylindrical peripheral wall.

2. The method of claim 1, wherein said simultaneous forming step includes forming flared flanges at opposite ends of the thickened portion, for supporting a poly-v belt, the flanges being rolled by complementarily-shaped edges of said outer roller.

3. The method of claim 1, further comprising folding of sheet metal material of said cup-shaped blank adjacent one of the flared flanges.

* * * * *